US008459055B2

(12) United States Patent
Kim et al.

(10) Patent No.: US 8,459,055 B2
(45) Date of Patent: Jun. 11, 2013

(54) AUGER IN ICE BIN AND REFRIGERATING MACHINE HAVING THE SAME

(75) Inventors: Yong-Su Kim, Seoul (KR); Seong-Jae Kim, Seoul (KR); Nam-Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1105 days.

(21) Appl. No.: 12/117,772

(22) Filed: May 9, 2008

(65) Prior Publication Data

US 2008/0295538 A1 Dec. 4, 2008

(30) Foreign Application Priority Data

May 28, 2007 (KR) ..... 10-2007-0051687

(51) Int. Cl.
*F25C 5/02* (2006.01)
*F25C 5/18* (2006.01)

(52) U.S. Cl.
USPC ..... 62/320; 62/344; 241/DIG. 17

(58) Field of Classification Search
USPC ..... 62/320, 344
See application file for complete search history.

(56) References Cited

U.S. PATENT DOCUMENTS 4,008,740 A * 2/1977 Chermack ..... 141/100
4,078,653 A * 3/1978 Suter ..... 198/625
4,972,999 A * 11/1990 Grace ..... 241/30
5,050,777 A * 9/1991 Buchser ..... 222/146.6
6,952,936 B2 10/2005 Sannasi
2006/0272347 A1* 12/2006 Park ..... 62/344

FOREIGN PATENT DOCUMENTS

JP 2005-257159 9/2005
KR 10-2006-0074189 7/2006
KR 10-2006-0132194 12/2006

OTHER PUBLICATIONS

International Search Report dated Sep. 23, 2008, for Application No. PCT/KR2008/002290, 10 pages.

* cited by examiner

*Primary Examiner* — Cheryl J Tyler
*Assistant Examiner* — Lakiya Rogers
(74) *Attorney, Agent, or Firm* — Fish & Richardson P.C.

(57) ABSTRACT

Disclosed is the auger in an ice bin mounted in a refrigerator, and the like. The auger in the ice bin is configured to rotate a plurality of augers having spiral-shaped transfer blades and to dispose ice in each space between the transfer blades of the auger for transfer. Accordingly, a certain amount of ice can always be discharged without simultaneously discharging a great amount of ice, and a user may select the number of ice, thus to diversity functions of an ice dispenser. In addition, since the auger is made of a flexible material, the ice can be prevented from being crushed during transfer, thereby enhancing the reliability of the ice dispenser.

20 Claims, 8 Drawing Sheets

AUGER IN ICE BIN AND REFRIGERATING MACHINE HAVING THE SAME

The present application claims priority to Korean Application No. 10-2007-0051687 filed in Korea on May 28, 2007, which is herein expressly incorporated by reference in its entirety.

BACKGROUND

1. Field

This disclosure relates to an auger in an ice bin, which is provided in a refrigerator or water purifier having an ice-making machine and is capable of discharging ice pieces incrementally, e.g., one by one.

2. Background Art

In general, an ice-making machine is a device that makes ice, and that is mounted in a refrigerator, a water purifier, etc. Many attempts have recently been made to diversify and improve the quality of offered refrigerating machines, such as a refrigerator, a water purifier, etc.

Refrigerating machines that include ice-making devices may be further provided with an auger in an ice bin, which is capable of discharging ice made by an ice-making machine without opening a refrigerator door. The auger in the ice bin is generally configured to store a large quantity of ice pieces in a storage chamber and to discharge a certain amount of ice when a user selects an option to discharge ice pieces.

In refrigerator machines having the aforementioned augers within their ice bins, the ice pieces stored in the storage chamber may be stuck together, making it difficult to discharge ice pieces smoothly or preventing smooth discharge altogether. Moreover, when the ice pieces are discharged, the ice pieces may be crushed, thereby varying the amount of ice being discharged, and potentially allowing for a great amount of ice to be discharged at one time.

SUMMARY

As embodied and broadly described herein, there is provided an auger in an ice bin which can regularly discharge ice pieces one by one without being crushed, and a refrigerating machine having the same.

An auger assembly in an ice bin, including: a first auger, disposed in parallel to an axis of first auger rotation and having at least two spiral-shaped transfer blades that protrude from the axis of auger rotation, a second auger disposed in parallel to an axis of second auger rotation and having at least two spiral-shaped transfer blades that protrude from the axis of second auger rotation, and an assembly that fixes the first and second auger in a relative orientation whereby the axis of first auger rotation and the axis of second auger rotation are in parallel to each other and whereby the transfer blades of the first and second augers have spaces that change in dimension based on coordinated rotation of the first and second augers, enabling the spiral-shaped transfer blades to work together while ice is disposed in spaces between the transfer blades of the augers to transfer the ice.

Implementations may include one or more of the following features. For example, each transfer blade of the first and second augers may include a shaft portion coupled to a rotation shaft of a motor, and an ice guide portion protruding from an outer circumferential surface of the shaft portion in a radial direction and spirally formed in a shaft direction so as to guide ice. An end of each end of the guide portions may have an edge relatively close to the rotation shaft that is connected by a reinforcing disk-shaped portion.

The first and second augers may be gear-coupled so as to be interworked with each other, and/or the augers may include a flexible material.

In another aspect, an auger assembly in an ice bin includes: a casing defining an ice storage chamber at an opened upper surface of the casing, a discharge opening disposed at a lower surface of the casing so as to discharge ice, and a transfer chamber positioned between the ice storage chamber and the discharge opening, the transfer chamber including a side surface defining a communication hole that accommodates ice passage; a motor positioned at one side of the casing to generate a rotation force; and augers rotatably mounted in parallel to each other inside the casing, the augers being configured to rotate based on rotational force generated by the motor and each having at least two spiral-shaped transfer blades extending in a circumferential direction so as to dispose ice from the ice storage chamber into spaces between the transfer blades and to transfer the ice to the communication hole of the casing.

Implementations of this second aspect may include one or more of the above or following features. For example, an ice guide unit may be inclined in upper and lower directions at a rear direction of the communication hole of the casing so as to guide ice disposed in the auger toward the communication hole. The communication hole of the casing may have a shape that is consistent with space formed between the transfer blades of the auger. One of the augers may be coupled to a rotation shaft of the motor, and another of the augers is configured to be rotatable in a free state or for rotation responsive to a rotation force generated by the auger coupled to the rotation shaft of the motor.

A gear coupling may enable auger interworking, and the auger assembly may include: auger fixing members configured to each auger, each auger fixing member being inserted into the rotation shaft, and gear portions disposed to be engaged with each other on an outer circumferential surface of each of the auger fixing members.

The augers may also or alternatively include a shaft portion coupled to the rotation shaft of the motor, and the transfer blades spirally protruding from an outer circumferential surface of the shaft portion in a circumferential direction with a fixed distance therebetween so as to guide ice. A reinforcing disk-shaped portion may be configured to connect ends of the transfer blades that face the shaft portion.

The communication hole may have a height that is not less than a height of at least one of the augers, or that is less than a height of at least in of the augers.

A grind chamber may define a through-hole at a lower surface thereof, and may be positioned on a side of the communication hole of the casing opposite of the augers so as to guide ice to the discharge opening, with the auger having an ice grinder disposed in the grind chamber so as to discharge ice or to grind ice for discharge. The ice grinder and auger may both be configured to rotate responsive to rotational force generated by the motor, with the ice grinder being configured to grind ice by disposing the ice between rotary blades and fixed blades. The rotary blades and the fixed blades may be positioned within the ice grinder in an alternating manner.

A shutter may be disposed at the through-hole to select the size of ice discharged, where the shutter may be disposed at the through-hole to select the size of ice discharged, further comprising an assembly that moves the shutter based on ice grinder operational status such that ice grinder operation results in shutter closure, and an ice grinder idle period results in shutter opening.

The auger may be controlled to discharge a piece of ice every time when the auger is rotated by as much as a gap between the transfer blades.

In a third aspect, a refrigerating machine includes: a refrigerating machine case; an ice-making unit positioned in the refrigerating machine case to make ice; augers having one or more of the attributes articulated with respect to any of the aspects described above and disposed inside the refrigerating machine case, so as to discharge ice to the outside of the refrigerating machine case; a selection unit disposed outside the refrigerating machine case so as to allow a user to select an amount of ice required; and a control unit electrically connected between the auger in the ice bin and the selection unit to operate the auger in the ice bin according to a selection made by the selection unit. In one implementation, the control unit translates the amount of ice selected by the user into a rotation angle required by the auger provided in the auger in the ice bin.

In a fourth aspect, an auger assembly has at least two augers within a refrigeration device, and the auger assembly includes: a first auger with multiple transfer blades that extend along at least a first auger rotational axis and that are configured to rotate based on rotation of the first auger, a radius of the first auger being defined by a distance measured radially between the first auger rotational axis and an edge of an outermost one of the transfer blades of the first auger; a first auger gear configured to promote rotation of the first auger in a first rotational direction; a second auger with multiple transfer blades that extend along at least a second auger rotational axis and that are configured to rotate based on rotation of the second auger, a radius of the second auger being defined by a distance measured radially between the second auger rotational axis and an edge of an outermost one of the transfer blades of the second auger; a second auger gear configured to promote rotation of the second auger in a second rotational direction that differs from the first rotational direction, wherein the first and second auger rotational axes are separated by a distance that is less than a sum of the radii of the first and second augers such that transfer blades of the first and second augers each advance through a common area on a plane extending between the first and second auger rotational axes.

Implementations of this fourth aspect may include one or more of the above or following features. For example, at least one of the transfer blades of the first and second auger may have a spiral configuration about the rotational axis of a corresponding one of the first and second augers. The second auger gear may be configured to promote rotation of the second auger in a second rotational direction that is opposite to the first rotational direction.

In a fifth aspect, an auger assembly is positioned within a refrigeration device including an ice maker configured to produce ice cubes of a full size defined by individual ice compartments within an ice tray of the ice maker, and includes: an input configured to receive user selection of desired ice volume; at least two reciprocal augers to regulate and promote movement of ice moving out of an ice storage bin within the ice maker; and blades on each of the augers, extending along at least an auger axis of rotation; and an auger gear assembly having at least one auger gear, the auger gear assembly being configured to rotate the augers synchronously to enable the blades of the augers to rotate repeatedly in accordance with the user selection of desired ice volume to: (1) respective first positions, whereby the blades of the augers collectively block an ice cube of full size from passing out of the ice storage bin, (2) respective second positions, whereby the blades of the augers collectively define a space that is sufficiently sized to accommodate and advance an ice cube of full size from the ice storage bin, but insufficiently sized to accommodate and advance more than one ice cube of full size to pass together, and (3) respective third positions, whereby an ice cube accommodated by the defined space formed when the blades are in the second positions is made able to exit the auger assembly without further interference from the auger blades. In one implementation of the fifth aspect, the user selection of desired ice volume reflects a number of ice cubes desired.

DETAILED DESCRIPTION

Description will now be given in detail of the auger in an ice bin, examples of which are illustrated in the accompanying drawings.

Figure 1:
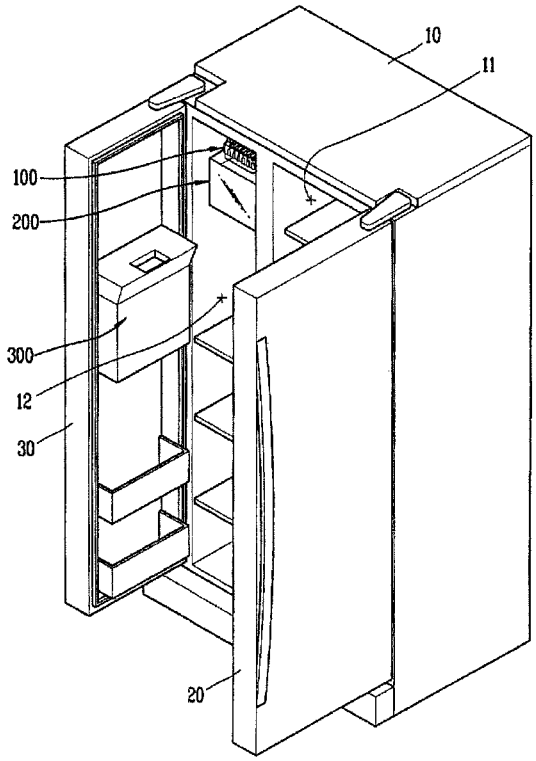
FIG. 1 is a perspective view showing a refrigerator.

As shown in FIG. 1, a refrigerator to which an auger in an ice bin is applied includes a refrigerator main body 10, a refrigerator door 20 that may be opened or closed to expose or restrict access to a refrigerating chamber 11 of the refrigerator main body 10, and a freezer door 30 for opening/closing a freezing chamber 12 of the refrigerator main body 10. There are further provided an ice-making machine 100 disposed at an inner side of the freezing chamber 12 for making ice, an ice bin 200 disposed below the ice-making machine 100, an auger in the ice bin 200 for storing ice made by the ice-making machine 100, and an ice dispenser 300 disposed outside the freezer door 30 for dispensing ice stored in the ice bin 200 according to a user's need.

Figure 2:
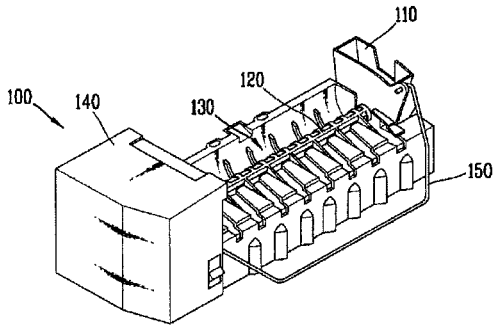
FIG. 2 is a perspective view showing an ice-making machine applied to the refrigerator.

As shown in FIG. 2, the ice-making machine 100 is configured to have a water supply unit 110 for supplying water from a source outside of the refrigerator, an ice-making chamber 120 for making ice by using water supplied from the water supply unit 110, an ejector 130 for separating ice made by the ice-making chamber 120, and a control box 140 for mounting many components therewithin so as to rotate the ejector 130. A mount unit (not shown) for mounting the ice-making machine 100 inside the refrigerator is provided at a rear direction of the ice-making chamber 120, and an ice level sensing lever 150 is disposed at a front direction of the ice-making chamber 120 to check that the ice-making machine 100 stops operating when the ice bin 200 is fully filled with ice pieces.

Figure 3:
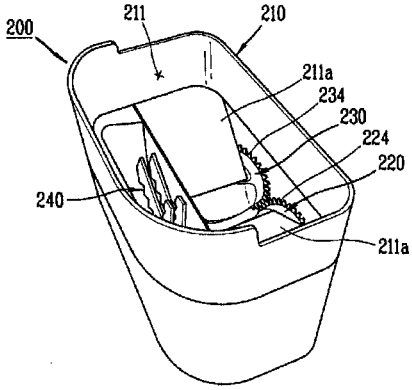
FIG. 3 is a perspective view showing an ice bin applied to the refrigerator.

As shown in FIG. 3, the ice bin 200 is provided with a casing 210 having a certain inner space, a motor (not shown) disposed at one side of the casing 210 to generate a rotation force, and first and second augers 220, 230 disposed in parallel to each other, having at least one side thereof coupled to a rotation shaft of the motor and disposing ice pieces in each space between the augers 220, 230 for transfer.

Figure 4:
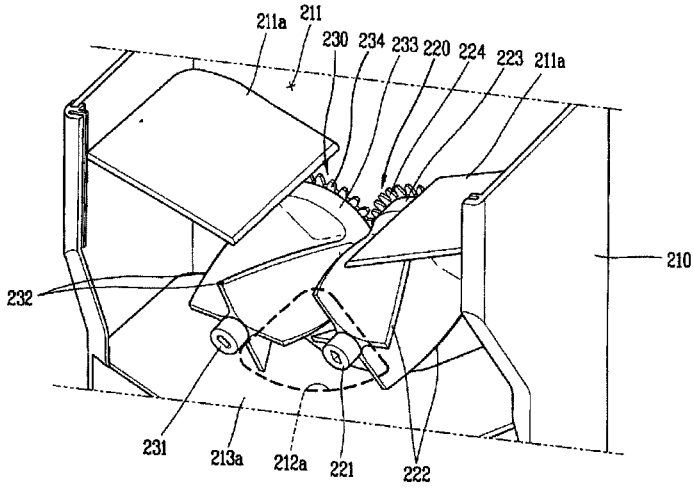
FIG. 4 is a perspective view showing an inside of the ice bin of FIG. 3.
Figure 5:
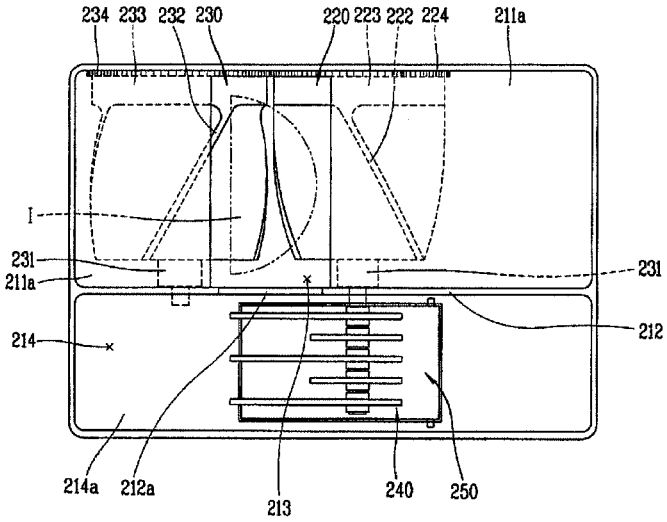
FIG. 5 is a plane view showing the ice bin of FIG. 4.
Figure 6:
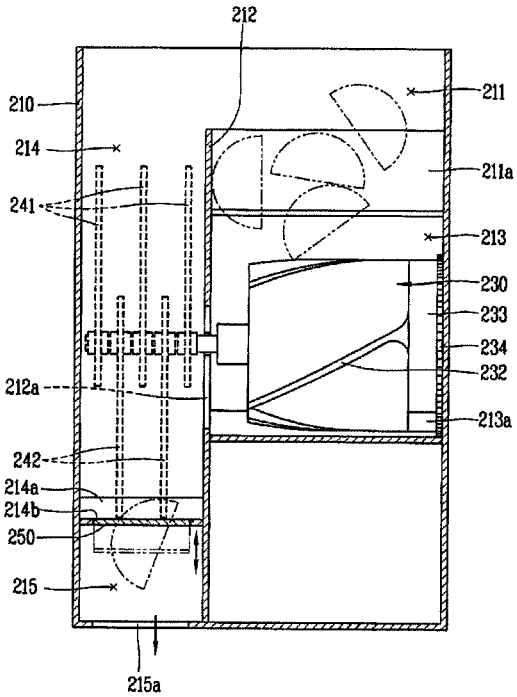
FIG. 6 is a longitudinal cross-sectional view showing the ice bin of FIG. 4.

As shown in FIGS. 4 and 6, an ice storage chamber 211 is disposed at an upper side of the casing 210 so as to store ice transferred from the ice-making machine 100. A partition wall 212 having a communication hole 212*a* is disposed in the casing 210. And, a transfer chamber 213 in which the first and second augers 220, 230 are mounted is disposed at one side of the partition wall 212. Further, first guides 211*a* positioned between the ice storage chamber 211 and the transfer chamber 213 may be downwardly inclined toward a central direction from each surface of both partition walls of the ice storage chamber 211 so as to smoothly direct ice to the transfer chamber 213. A second guide 213*a* may be curvedly formed on a bottom of the transfer chamber 213 such that the first and second augers 220, 230 can be smoothly rotated.

A grind chamber 214 is disposed at another side of the partition wall 212 to mount an ice grinder 240, as will be described later. A discharge space 215 having a discharge opening 215*a* on a bottom surface thereof is disposed at a lower portion of the grind chamber 214. A third guide 214*a* is mounted between the grind chamber 214 and the discharge space 215. A through-hole 214*b* is positioned at the third guide 214*a* so as to enable communications between the grind chamber 214 and the discharge space 215. A shutter 250, which will be described later, is rotatably mounted at the through-hole 214*b*.

Both inner surfaces of the casing 210 in a width direction may be formed to have a width enough to nearly contact both side surfaces of the augers 220, 230 in a lengthwise direction so as to prevent ice from falling to other spaces or from being trapped between both ends of each auger 220, 230 and the casing 210. Moreover, the communication hole 212*a* of the casing 210 may be formed to have almost the same shape as each space between the transfer blades 222, 232 of the augers 220, 230 such that the ice pieces transferred by being stored in each space between the first and second augers 220, 230 can be individually discharged.

As shown in FIG. 4, the first auger 220 is configured to have a shaft portion 221 coupled to the rotation shaft of the motor disposed at a rear direction of the casing 210, and a plurality of transfer blades 222, each spirally protruding from an outer circumferential surface of the shaft portion 221 in a circumferential direction with a certain distance therebetween so as to guide ice. In the first auger 220, the gap between the transfer blades 222 is formed to be almost the same as a size of individual ice pieces stored in the ice storage chamber 211 of the casing 210 such that the individual ice pieces can be disposed in each space between the transfer blades 222. In the first auger 220, end portions of the transfer blades 222 corresponding to an opposite side of the communication hole 212*a* of the casing 210 are connected to each other by a disk-shaped reinforcing portion 223, thereby supporting the transfer blades 222.

The second auger 230 is formed in almost the same manner as the first auger 220. Here, the transfer blades 232 of the second auger 230 may be wound on the shaft 231 in an opposite direction to the transfer blades 222 of the first auger 220. And, the second auger 230 may be mounted at a separate shaft fixed to the casing 210 so as to perform a free rotation, or may be coupled to a separate motor so as to be rotatable with the first auger 220. Also, as with auger 220, the end portions of the transfer blades 232 of auger 230 are connected to each other by a disk-shaped reinforcing position 233.

If the second auger 230 is mounted at the casing 210 to perform a free rotation, the second auger 230 can be spaced from the first auger 220 with a certain distance therebetween so as to be in a free state, or can be interworked with the first auger 220 so as to be rotatable with the first auger 220 in an opposite direction thereto. For instance, at the outside of the first auger 220, the first gear 224 is coupled to the rotation shaft of the motor, and at the outside of the second auger 230, the second gear 234 is coupled to the shaft supporting the second auger 230. The first gear 224 and the second gear 234 are engaged to each other, thus a rotation force of the first gear 224 may be transferred to the second gear 234 for interworking. The first and second gears 224, 234 may include a gear portion on an outer circumferential surface of each auger fixing member (not shown) which is forcibly inserted into the outside of each auger 220, 230 so as to prevent the first and second augers 220, 230 from being separated from each shaft thereof.

The transfer blades 222 of the first auger 220 and the transfer blades 232 of the second auger 230 may be configured to be rotated while contacting outer circumferential surfaces thereof to each other and to dispose ice in each space between the transfer blades 223, 232. However, in some cases, the transfer blades 222 of the first auger 220 may be rotated by being disposed between the transfer blades 232 of the second auger 230, so as to dispose ice in each space between the transfer blades 222 of the first auger 220 and in each space between the transfer blades 232 of the second auger 230 in an alternating manner.

The transfer blades 232 of the second auger 230 may be wound on the shaft in the same direction as the transfer blades 222 of the first auger 220. Here, the transfer blades 222 of the first auger 220 and the transfer blades 232 of the second auger 230 may be rotated to contact each other, or may be rotated to be engaged with each other in an alternating manner.

Further, the first and second augers 220, 230 may be formed of a flexible material so as to prevent ice from being crushed during storage or transfer of ice.

The first and second augers 220, 230 may be configured to discharge a piece of ice every time when the first and second augers 220, 230 are rotated by as much as the gaps between the transfer blades 222, 232. For instance, if the transfer blades 222, 232 are each provided with 4 transfer blades spaced with an approximately 90 degrees interval from each other, a piece of ice can be discharged every time when the first and second augers 220, 230 are rotated by 90 degrees (i.e., by ¼). Here, if a user uses the selection unit provided in the ice dispenser 300 to select the number of ice pieces, the control unit (not shown) having received the selection signal determines a rotation angle of the motor operating the first auger 220 and then discharges ice pieces by as much as the numbers selected. The control unit may be configured that if, as shown in FIG. 6, the transfer blades 222, 232 of the augers 220, 230 are disposed by 90 degrees interval and the user selects 3 pieces of ice, the first and second augers 220, 230 are rotated by only ±270 degrees and then are stopped after sequentially discharging 3 pieces of ice.

Meanwhile, the grind chamber 214 having the through-hole 214*b* on the bottom surface thereof to guide ice to the discharge opening 215*a* is further provided outside the communication hole 212*a* of the casing 210. An ice grinder 240 may further be provided in the grinder chamber 214 to discharge ice or to grind ice for discharge. And, a shutter 250 may be disposed at the through-hole 214*b* to select the size of ice discharged.

Figure 7:
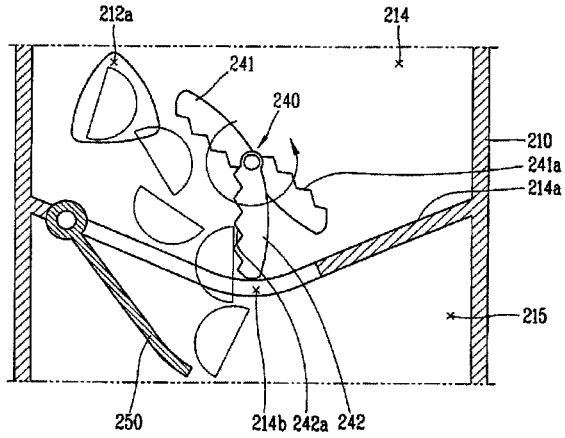
FIGS. 7 and 8 are schematic views each showing an operational state of a grinder applied to the ice bin.
Figure 8:
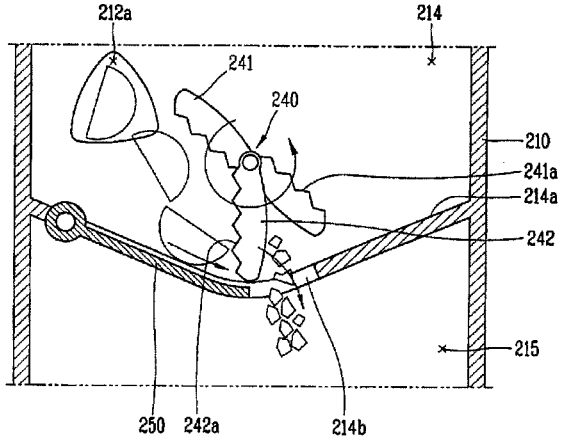

As shown in FIGS. 7 and 8, the ice grinder 240 may be operated by the same motor as the first auger 220, but, in some cases, may be operated with a separate motor for grinding. And, the ice grinder 240 includes a plurality of rotary blades 241 rotated by being coupled to the motor for rotating the auger or the motor for grinding, and a plurality of fixed blades 242 disposed between the plurality of rotary blades 241. The ice grinder 240 is configured to grind ice by disposing the ice between the rotary blades 241 and the fixed blades 242.

The rotary blades 241, as described above, may be rotated by coupling to the same shaft as the first auger 220, or may be rotated by a separate motor shaft. And, a knife blade 241*a* curved in a longitudinal direction of the rotary blades 241 is formed on a side surface of the rotary blades 241 in a rotation direction so as to transfer or grind ice being transferred by the transfer blades 222 of the auger 220.

The fixed blades 242 are fixed above the discharge space 215, and a knife blade 242*a* curved in a longitudinal direction of the fixed blades 242 is formed on a side surface corresponding to and facing the knife blade 241*a* of the rotary blades 241 so as to grind ice together with the knife blade 241*a* of the rotary blades 241.

As shown in FIGS. 7 and 8, the shutter 250 is curvedly formed with a certain length in a radius of rotation of the rotary blades 241. One side of the rotary blades 241 is hinge-coupled to and edge of the through-hole 214*b* such that the shutter 250 of the casing 210 can be rotated with respect to the surface of the third guide 214*a*. And, the shutter 250 is selectively opened by the rotation of the rotary blades 241. Further, a manipulation lever (not shown) for upwardly supporting the shutter 250 is disposed at a lower end surface of the shutter 250 so as to maintain the state that the shutter 250 has closed the through-hole 214*b*. The manipulation lever is pivotably coupled to the casing 210 so as to perform an opening/closing operation of the shutter 250.

The auger in the ice bin is operated as follows in one implementation:

Ice pieces made in the ice-making chamber 120 of the ice-making machine 100 are transferred and piled up, by the ejector 130, to the ice storage chamber 211 disposed at the upper side of the casing 210 of the ice bin 200. The ice pieces piled up in the ice storage chamber 211 remain piled up until before the user selects an option to discharge ice from the dispenser 300. Here, through the ice level sensing lever 150 disposed in the ice-making machine 100, a proper amount of ice should always be piled up in the ice storage chamber 211.

Figure 9:
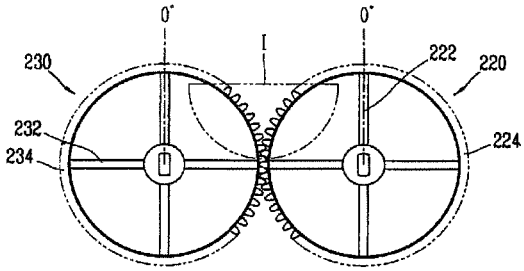
FIGS. 9 through 11 are diagrams respectively showing an operation of the auger in the ice bin.
Figure 10:
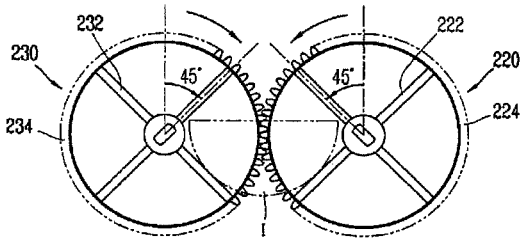

If the user selects the option to discharge ice from the ice dispenser 300, the motor of the ice bin 200 operates and the first auger 220, as shown in FIGS. 9 and 10, is thereby rotated in a counter-clockwise direction in the drawing. And, the second auger 230 engaged with the first auger 220 or being in a free rotation state is rotated in a clockwise direction. Accordingly, the ice pieces piled up in the ice storage chamber 211 are introduced into each space between the transfer blades 222, 232 of the first and second augers 220, 230. Here, the ice pieces piled up in the ice storage chamber 211 may be stuck together, thereby causing a plurality of ice pieces to be simultaneously introduced into the spaces between the transfer blades 222, 232 of the augers 220, 230. However, the spaces each formed between the transfer blades 222, 232 of the first and second augers 220, 230 are formed to have an area of a piece of ice. Further, as the first auger 220 and the second auger 230 are rotated in an opposite direction to each other, or as the first auger 220 is rotated toward the second auger 230 being in the free rotation state, the ice is passed through the spaces between both augers 220, 230 and then moved to the communication hole 212*a* of the casing 210, thereby preventing the plurality of ice pieces from simultaneously being introduced into the communication hole 212*a*.

Figure 11:
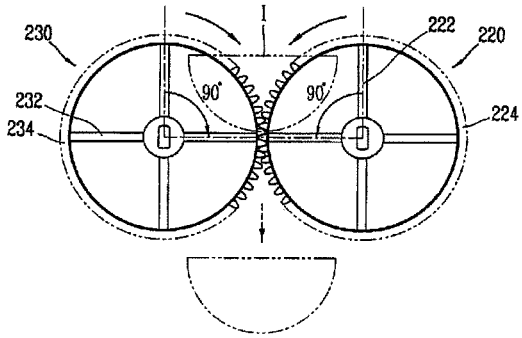

As shown in FIGS. 10 and 11, each of the first and second augers 220, 230 is further rotated in an opposite direction to each other while receiving ice in each space between the transfer blades 222, 232, and transfers ice from the upward to downward direction. During this process, the ice is slid along the transfer blades 222, 232 of the augers 220, 230 and then discharged into the grind chamber 214 through the communication hole 212*a*. Here, one or two pieces of ice may be received in the augers 220, 230 for transfer. However, when many pieces of ice (more than 1-2 pieces of ice) are received in the augers 220, 230 for transfer due to unexpected situations, the communication hole 212*a* is formed to have a width enough for approximately only one or two pieces of ice to be transferred, thereby preventing the plurality of ice pieces from simultaneously being transferred into the discharge space 215.

Thereafter, the ice transferred to the discharge space 215 may be directly guided to the discharge opening 215*a* by the rotary blades 241 of the grinder 240 disposed in the discharge space 215, or may be guided into the discharge opening 215*a* by being grinded as ice pieces in the spaces between the rotary blades 241 and the fixed blades 242 of the grinder 240. That is, when the user selects an option to discharge a block of ice, instead of ice pieces, the shutter 250 mounted at the through-hole 214*b* is opened, as shown in FIG. 7, and the block of ice introduced into the discharge space 215 is directly guided, without being crushed, to a guide passage of the dispenser 300 through the discharge opening 215*a*. On the contrary, if the user selects an option to discharge ice pieces, the shutter 250 is closed, and the block of ice is grinded in the space between the rotary blades 241 and the fixed blades 242 and is thereby guided to the guide passage of the dispenser 300 through the discharge opening 215*a*.

Thus, since ice pieces made by the ice-making machine are individually separated and discharged from the auger of the ice bin made of the flexible material, the ice pieces can be discharged without being crushed as well as a great amount of ice can be prevented from simultaneously being discharged.

Meanwhile, another implementation of the auger in the ice bin will now be described.

Figure 12:
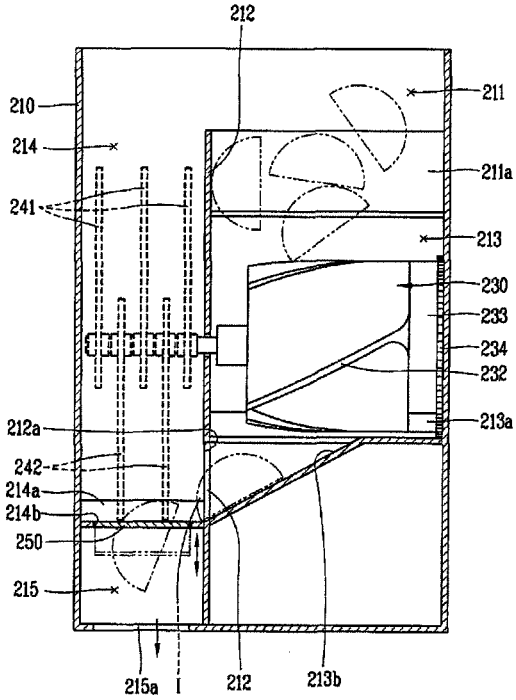
FIG. 12 is a longitudinal cross-sectional view showing the location of a communication hole in the ice bin.

In the previous embodiment, the communication hole 212*a* is disposed at an upper side of the partition wall 212 (i.e., at one side of the first and second augers 220, 230) and ice is transferred to the grind chamber 214 before passing through the auger, (i.e., in the middle height of the auger). However, in this embodiment, as shown in FIG. 12, the communication hole 212*a* is disposed at a lower side of the partition wall 212 (i.e., to be lower than the height of the auger). An inclined surface 213*b* is positioned downwardly inclined to the grind chamber 214 at the lowest portion of the second guide 213*a*, and the communication hole 212*a* is disposed at an end of the inclined surface 213*b*. Here, the communication hole 212*a* should be positioned at a higher location than the third guide 214*a* so as to discharge ice individually to the discharge space 215.

Such an operational effect is almost the same as that in the previous embodiment. Here, in this embodiment, the ice is transferred to the grind chamber 214 after completely passing through the augers 220, 230. Accordingly, the broken ice pieces, which could not be transferred to the grind chamber 214 after passing through the spaces between the augers 220, 230 in the previous embodiment, can be prevented from remaining in the space between the second guide 213*a* and the auger.

The auger in the ice bin is configured to rotate the plurality of augers having spiral-shaped transfer blades and to dispose ice in each space between the transfer blades of the augers so as to transfer ice. Thus, a fixed amount of ice or an amount of ice selected by the user can always be discharged. Further, the auger is made of the flexible material, thereby preventing ice from being crushed during the transfer process.

Even though the present embodiment describes the auger in the ice bin applied to the refrigerator, the auger in the ice bin may also be applied to the water purifier and other refrigerating machines, as mentioned above. Also, the auger in the ice bin may be disposed together with the ice-making machine or the dispenser, but in some cases, it may be independently disposed.

What is claimed is:

1. An auger assembly in an ice bin, comprising:

a casing defining an ice storage chamber at an opened upper surface of the casing, a discharge opening disposed at a lower surface of the casing so as to discharge ice, and a transfer chamber positioned between the ice storage chamber and the discharge opening, the transfer chamber including a side surface defining a communication hole that accommodates ice passage; and first and second augers rotatably mounted in parallel to each other inside the casing, the augers being configured to rotate and each having at least two spiral-shaped transfer blades extending in a circumferential direction so as to dispose ice from the ice storage chamber into spaces between the transfer blades and to transfer the ice to the communication hole of the casing, wherein, at a point during rotation of the first and second augers, an outer circumferential surface of a first transfer blade of the first auger contacts an outer circumferential surface of a second transfer blade of the second auger, wherein a gap between the outer circumferential surface of the first transfer blade of the first auger and the outer circumferential surface of the second transfer blade of the second auger changes during rotation of the first and second augers such that the first and second augers transfer ice in an upward to downward direction, wherein the first auger has a shaft portion, and the spiral-shaped transfer blades spirally protrude from an outer circumferential surface of the shaft portion in a circumferential direction with a certain distance therebetween so as to guide ice, wherein a first gear is coupled to the shaft portion at an outside of the first auger, a second gear is coupled to a shaft supporting the second auger at an outside of the second auger, and the first gear and the second gear are engaged to each other such that a rotation force of the first gear is transferred to the second gear to rotate the second gear with the first gear by a gear coupling, and wherein the second auger is mounted to be rotatable in a free state such that the second auger is rotated by a rotation force generated by the first gear of the first auger when the first auger rotates.

2. The auger assembly of claim 1, wherein the communication hole of the casing has a shape that is consistent with space formed between the transfer blades of the augers.

3. The auger assembly of claim 1, wherein the augers include a flexible material so as to prevent ice from being crushed by the augers during rotation.

4. The auger assembly of claim 1, further comprising a reinforcing disk-shaped portion configured to connect ends of the transfer blades that face the shaft portion.

5. The auger assembly of claim 1, wherein a height of the communication hole is not less than a height of at least one of the augers.

6. The auger assembly of claim 1, wherein a height of the communication hole is less than a height of at least one of the augers.

7. The auger assembly of claim 1, further comprising a grind chamber defining a through-hole at a lower surface thereof, the grind chamber being positioned on a side of the communication hole of the casing opposite of the augers so as to guide ice to the discharge opening.

8. The auger assembly of claim 7, further comprising an ice grinder disposed in the grind chamber so as to discharge ice or to grind ice for discharge.

9. The auger assembly of claim 8, wherein the ice grinder and auger are both configured to rotate.

10. The auger assembly of claim 9, wherein the ice grinder is configured to grind ice by disposing the ice between rotary blades and fixed blades.

11. The auger assembly of claim 10, wherein the rotary blades and the fixed blades are positioned within the ice grinder in an alternating manner.

12. The auger assembly of claim 7, further comprising a shutter disposed at the through-hole to select the size of ice discharged.

13. The auger assembly of claim 1, wherein the augers are controlled to discharge a piece of ice every time when the augers are rotated by as much as a gap between the transfer blades.

14. An auger assembly in an ice bin, comprising:

a casing defining an ice storage chamber at an opened upper surface of the casing, a discharge opening disposed at a lower surface of the casing so as to discharge ice, and a transfer chamber positioned between the ice storage chamber and the discharge opening, the transfer chamber including a side surface defining a communication hole that accommodates ice passage; and first and second augers rotatably mounted in parallel to each other inside the casing, the augers being configured to rotate and each having at least two spiral-shaped transfer blades extending in a circumferential direction so as to dispose ice from the ice storage chamber into spaces between the transfer blades of the first auger and the transfer blades of the second auger and to transfer the ice to the communication hole of the casing, wherein, at a point during rotation of the first and second augers, an outer circumferential surface of a first transfer blade of the first auger contacts an outer circumferential surface of a second transfer blade of the second auger, and wherein a gap between the outer circumferential surface of the first transfer blade of the first auger and the outer circumferential surface of the second transfer blade of the second auger changes during rotation of the first and second augers such that the first and second augers transfer ice in an upward to downward direction.

15. The auger assembly of claim 14, wherein the communication hole of the casing has a shape that is consistent with space formed between the transfer blades of the augers.

16. The auger assembly of claim 14, wherein the augers include a flexible material so as to prevent ice from being crushed by the augers during rotation.

17. The auger assembly of claim 14, further comprising a reinforcing disk-shaped portion configured to connect ends of the transfer blades that face the shaft portion.

18. The auger assembly of claim 14, wherein a height of the communication hole is not less than a height of at least one of the augers.

19. The auger assembly of claim 14, wherein a height of the communication hole is less than a height of at least one of the augers.

20. The auger assembly of claim 14, further comprising a grind chamber defining a through-hole at a lower surface thereof, the grind chamber being positioned on a side of the communication hole of the casing opposite of the augers so as to guide ice to the discharge opening.

* * * * *